United States Patent [19]

Hanson

[11] 4,317,297

[45] Mar. 2, 1982

[54] FOOTWEAR WITH ADJUSTABLE FLEXURE

[75] Inventor: Chris A. Hanson, Boulder, Colo.

[73] Assignee: Hanson Industries Incorporated, Boulder, Colo.

[21] Appl. No.: 130,199

[22] Filed: Mar. 13, 1980

[51] Int. Cl.[3] ..... A43B 5/04

[52] U.S. Cl. ..... 36/121

[58] Field of Search ..... 36/121

[56] References Cited

U.S. PATENT DOCUMENTS 3,945,135 3/1976 Hanson et al. ..... 36/121

FOREIGN PATENT DOCUMENTS 2262453 2/1974 Fed. Rep. of Germany ..... 36/121

*Primary Examiner*—Patrick D. Lawson

*Attorney, Agent, or Firm*—Merriam, Marshall & Bicknell

[57] ABSTRACT

Improved footwear, such as a ski boot having a substantially rigid shell, a slip joint defined at the instep area between a vamp portion extending upwardly and an upper shell portion extending downwardly with a portion overlying the vamp at the instep area provide boot flexure. A slit in the upper shell portion commences at the joint and extends upwardly. Threaded adjustable fastening means are positioned across the slit so that the amount of boot flexure can be adjusted.

5 Claims, 4 Drawing Figures

FOOTWEAR WITH ADJUSTABLE FLEXURE

This invention relates to ankle-covering boots suitable for use in sports footwear, such as custom-fitted ski boots and improvements therein to enable the boot to flex in response to the force of the skier's ankle when the skier is in a forward lean position.

BACKGROUND OF THE INVENTION

Reference may be made to the following U.S. Pat. Nos. of interest: 3,798,799; 3,848,347; 3,882,561; and 4,083,127, all assigned to the same assignee as herein.

Many ski boots presently available comprise a substantially rigid outer shell generally made of a plastic material. A liner member is normally disposed within the shell and serves as a cushion between the shell and the foot of a skier. Generally, it is desired to have the ski boot and its components adapted to surround and be contoured to custom-fit the wearer's foot. In such cases, the boot is to provide a support function for the wearer's foot and ankle and enable firm contact to be obtained between the foot and the boot. Reference may be made to the aforementioned U.S. Pat. Nos. 3,798,799 and 3,882,561 wherein the custom fitting operation is disclosed.

Because of the relatively stiff plastic materials utilized in ski boot shells, the shell of the boot is substantially rigid. Thus, when the skier is in a forward leaning position, at which time the knees of the skier generally are located above and slightly in front of the boot, pressure is exerted against the front portion of the boot. Reference may be made to U.S. Pat. No. 3,848,347 and 4,083,127 wherein there is illustrated means for readily adjusting the flex in the shell of a ski boot. Flexure is provided by means of an upwardly diverging slit or split portion of the boot in the instep area with fastening means across the slit or split portion for varying the slit width and thereby changing the flex. It has been found that if the skier widens the slit or split portion to obtain more boot flexure, this undesirably loosens the tightness or rigidity in the lower leg portion of the boot. In some cases the increased looseness cannot be overcome by tightening the boot buckles. Thus, it is desired to provide a means for adjusting the boot flexure in a normally, substantially rigit boot shell without at the same time loosening the top portion of the boot.

SUMMARY OF THE INVENTION

A substantially rigid boot shell is provided with a slip joint at the front of the boot extending across the boot instep. The slip joint is defined between the boot vamp portion extending upwardly on the instep area and a top boot portion extending downwardly to overlie the vamp portion at the instep area. A slit is provided in the top boot portion commencing at the joint and extending upwardly to terminate in the top boot portion. Adjustable fastening means are selectively positioned across the slit so that the amount of boot flexure can be adjusted.

In the unique flexure provision of the present invention, increasing boot flexure is accomplished by moving the fastening means to a higher position across the slit. This operation does not lessen boot tightness in the lower leg boot portion as in the prior art. Similarly, moving the fastening means to a lower slit position narrows the slit width. Thus, adjusting boot flexure does not tend to change boot tightness in the lower leg boot portion.

DETAILED DESCRIPTION

The unique boot flexure adjusting means according to the present invention is illustrated and described in connection with a ski boot as shown in FIGS. 1–4. It is to be understood that this illustration is for the purpose of describing a specific embodiment, whereas the inventive features can be applied to other types of sports footwear as well.

Figure 1:
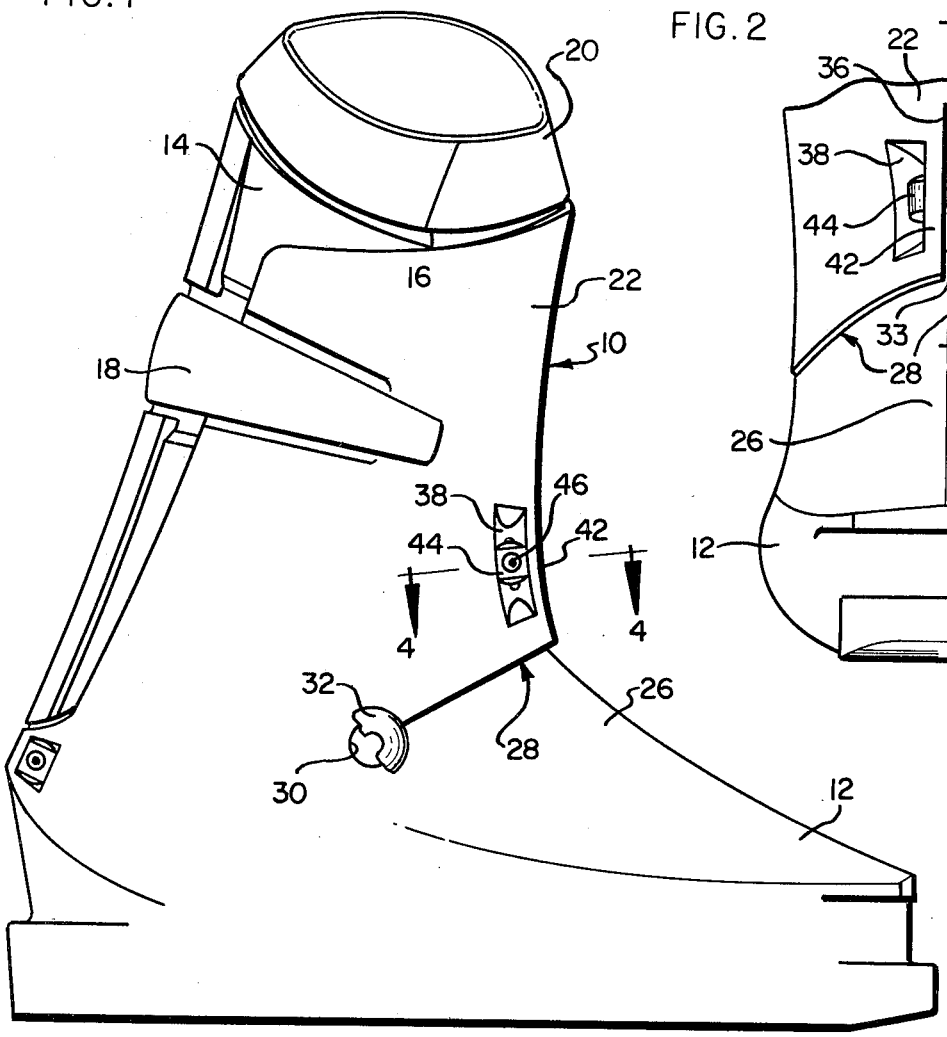
FIG. 1 is a side elevational view illustrating a ski boot incorporating a slip joint at the instep area defined between the boot vamp portion and top boot portion.

Referring now to FIG. 1, there is illustrated a ski boot 10 having a substantially rigid outer shell 12 of the rear entry type. The boot 10 includes a substantially non-compressable stiff plastic material forming a one-piece outer shell 12. An upright shell portion 14 extends around the wearer's lower leg to lie beneath upright shell portion 16. Shell portions 14 and 16 may be spread apart to enable entry of a skier's foot within the shell 12. Closure means 18 releasably locks shell portions 14 and 16 and permits the wearer to adjustably tighten the boot on his foot. A liner 20 formed of polyurethane foam or other substantially flexible material is contoured to fit within the shell 12. It is to be understood that both the liner 20 and the outer shell 12 are split in the area of boot portions 14 and 16, from the top thereof downwardly to the heel of the boot to permit entry and removal of the wearer's foot.

A portion 22 of shell 12 extends from the top of the boot at the wearer's lower leg area downwardly to overlie a portion 24 of boot vamp 26 in the instep area. The spatial separation and overlying of boot portion 22 above vamp portion 24 defines a slip joint 28 extending across the boot instep area. Slip joint 28 is terminated at each respective boot sides by a circular aperture 30 in outer shell 12. The apertures 30 on each side of boot 10 enable the distribution of the stresses at this shell position which might otherwise tend to crack or tear the shell. A respective grommet 32 is inserted into aperture 30 to provide a weather-type seal for the shell 12.

Figure 2:
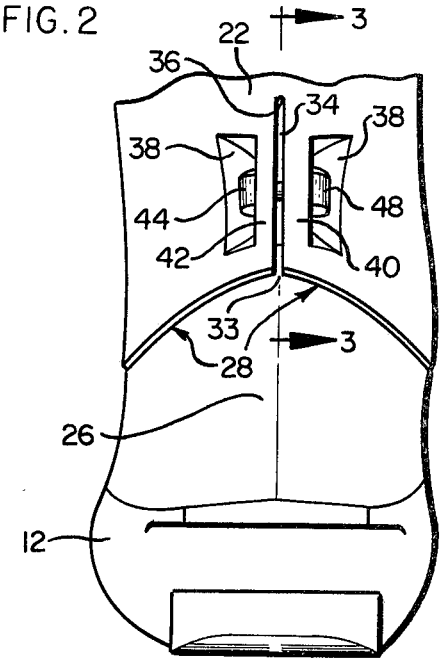
FIG. 2 is a fragmentary front elevational view of the boot shown in FIG. 1 illustrating the slip joint across the instep area and a slit in the top boot portion with fastening means provided to adjust the boot flexure.

Referring to FIG. 2, it can be seen that boot portion 22 includes a lower split section partially overlying the boot vamp and having an opening 33 at the split joint 28. Specifically, there is illustrated a slit 34 in boot portion 22 commencing at joint 28 and extending upwardly to terminate at end 36.

Figure 4:
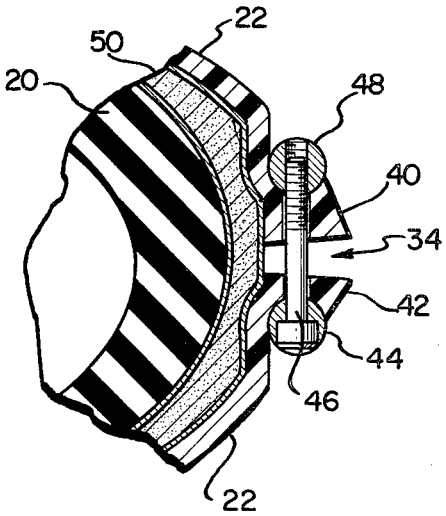
FIG. 4 is a fragmenary sectional view taken along section line 4—4 of FIG. 1 illustrating the top boot portion slit and adjustable fastening means across the slit for adjusting the boot flexure.

As illustrated in FIG. 4, top boot portion 22 includes a pair of recesses 38 on either side of slit 34 with suitable apertures through the respective shell wall sections 40, 42 to accommodate adjustable fastening means across the slit 34. A backing member 44 having a suitable aperture to accommodate a threaded screw 46 is placed in one recess 38 on one side of slit 34. A similar backing member 48 includes a threaded aperture and is placed on the opposite recess along side slit 34. Threaded screw 46 may be inserted through backing member 44 and adjustably threaded into backing member 48. Backing member 48 acts as a locking nut to maintain the screw position for the desired flexibility.

Figure 3:
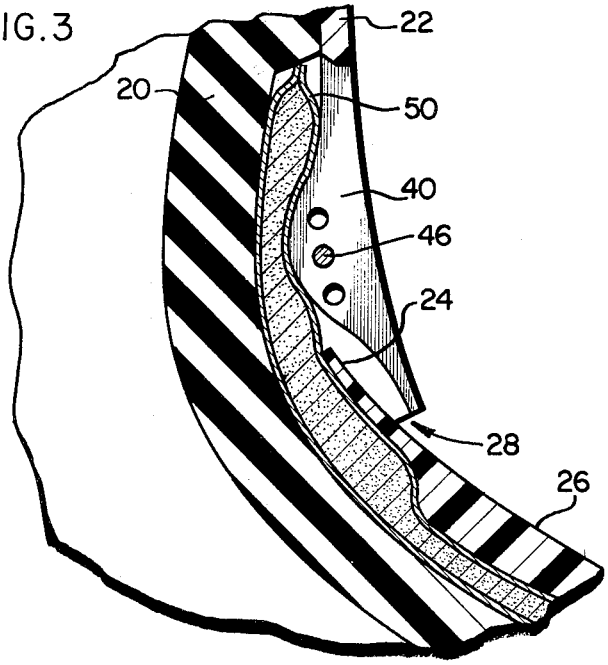
FIG. 3 is a fragmentary sectional view taken along section line 3—3 of FIG. 2 illustrating the top boot portion overlying a portion of the boot vamp to define a slip joint at the boot instep area.

Slip joint 28 across the instep area of boot 10 along with slit 34 in boot portion 22 provides boot flexure in the otherwise substantially rigid shell 12. Initially, the ski wearer inserts the threaded screw 46 and backing members 44 and 48 into one of the apertures across slit 34. It is to be understood that the positioning of the fastening means in the topmost position across slit 34 increases the boot flexure, whereas positioning the fastening means in the lowermost aperture position across slit 34 decreases the boot flexure. Thus, as opposed to the prior art, in accordance with the present invention increasing boot flexure does not loosen the boot tightness in the lower leg area. It may also be noted that decreasing boot flexure with the structure of the present invention also does not tend to change the tightness of the boot in the lower leg portion. In FIGS. 3 and 4 a pack 50 formed of soft, resilient material is inserted inside the boot at the slit joint 28 between liner 20 and the boot shell. The resilient pack 50 provides a flexible weather seal for the slip joint and slit 34.

While particular embodiments of the present invention have been shown and described, it will be obvious to those skilled in the art that various changes and modification may be made without departing from the invention in its broader aspects. Accordingly, the aim of the appended claims is to cover all such changes and modifications as may fall within the true spirit and scope of the invention.

Varying boot flexure can, for instance, be obtained by threadably adjusting fastener screw 46 and backing member 48 while they are located in one of the apertures to vary the width of slit 34. Thus, only one aligned aperture through walls 40,42 could be utilized, with the fastener means therein threadably adjusted to vary the slit width and thereby the boot flexure.

What is claimed is:

1. A ski boot with means for flexing said boot comprising:

a shell having closure means adapted for closing said shell about the foot and lower leg area of a skier;

a vamp portion of said shell extending upwardly in the instep area of said boot;

an upper boot portion of said shell extending from said lower leg area downwardly to overlie said vamp portion in the instep area of said boot;

a joint in said boot defined in the boot instep area between said vamp portion and said overlying upper boot portion; and said upper boot portion including a lower split section having an opening at said joint, said lower split section including a slit in said upper boot portion commencing at said joint, extending upwardly, and terminating in said upper boot portion, whereby said boot may be flexed at said instep area without loosening the top portion of the boot.

2. A ski boot according to claim 1, including adjustable fastening means mounted across said split section for adjusting said boot flexure at said instep area.

3. A ski boot according to claim 1, including positionable fastening means positionally mountable at wearer selected vertical positions across said slit.

4. A ski boot according to claim 3, wherein said positionable fastening means includes at least two selected vertical positions across said slit, with said topmost vertical position providing increased boot flexure compared to the lowermost vertical position.

5. A ski boot according to claim 3, wherein said lower split section includes period recesses aligned on opposite respective split sections, said positionable fastening means positionally mountable in said recesses.

* * * * *

UNITED STATES PATENT AND TRADEMARK OFFICE

CERTIFICATE OF CORRECTION

PATENT NO. : 4,317,297

DATED : March 2, 1982

INVENTOR(S) : Chris A. Hanson

It is certified that error appears in the above-identified patent and that said Letters Patent are hereby corrected as shown below:

Col. 2, line 16, change "fragmenary" to --fragmentary--;

Col. 4, line 37, change "period" to --paired--.

Signed and Sealed this

*Tenth* Day of *August 1982*

[SEAL]

*Attest:*

GERALD J. MOSSINGHOFF

*Attesting Officer*

*Commissioner of Patents and Trademarks*